US007285077B1

(12) United States Patent
Marx

(10) Patent No.: US 7,285,077 B1
(45) Date of Patent: Oct. 23, 2007

(54) DUMBBELL WORKBENCH

(76) Inventor: Matthew Marx, 50 Colgate Dr., Plainview, NY (US) 11803

( * ) Notice: Subject to any disclaimer, the term of this patent is extended or adjusted under 35 U.S.C. 154(b) by 558 days.

(21) Appl. No.: 10/732,779

(22) Filed: Dec. 9, 2003

(51) Int. Cl.
*A63B 21/078* (2006.01)
*A63B 26/00* (2006.01)

(52) U.S. Cl. ..... 482/104; 482/142

(58) Field of Classification Search ..... 482/104, 482/142, 94, 106–109; D21/681, 686
See application file for complete search history.

(56) References Cited

U.S. PATENT DOCUMENTS

| | | | | |
|---|---|---|---|---|
| 4,477,074 | A | 10/1984 | Bushnell | |
| 4,561,651 | A * | 12/1985 | Hole | 482/104 |
| 4,598,908 | A * | 7/1986 | Morgan | 482/138 |
| 4,666,150 | A * | 5/1987 | Segrist et al. | 482/104 |
| 4,960,277 | A * | 10/1990 | LaRossa et al. | 482/104 |
| 5,411,459 | A | 5/1995 | Hayden | |
| 5,472,397 | A | 12/1995 | Ammoscato et al. | |
| 5,616,108 | A | 4/1997 | Hayden | |
| 5,725,460 | A * | 3/1998 | Marsh | 482/104 |
| 5,776,037 | A * | 7/1998 | Millington | 482/91 |
| 5,924,964 | A | 7/1999 | Hayden | |
| 5,989,168 | A * | 11/1999 | See | 482/142 |
| 6,436,016 | B1 | 8/2002 | Valentino | |
| 6,709,370 | B1 * | 3/2004 | Evans | 482/104 |

FOREIGN PATENT DOCUMENTS

| | | |
|---|---|---|
| CA | 2164368 | 5/1997 |
| WO | WO99/39778 | 12/1999 |

* cited by examiner

*Primary Examiner*—Fenn C. Mathew
(74) *Attorney, Agent, or Firm*—Michael I Kroll

(57) ABSTRACT

The present invention 10 discloses a workout bench 26 having a plurality of incline adjustments and stanchions with means for receiving dumbbell weights 12. The dumbbell stanchion comprises a tubular structure 16 having a base portion 38 extending transversely to its distal ends, forming vertical stanchions. The vertical stanchions 16 comprise a weight rest stanchion 18 with weight rest 19 that is slidably adjustable having apertures 22 linearly arranged in conjunction with a locking pin 24 provided on the main vertical stanchions. The bench comprises two cushions 28 fixedly attached to individual frame structures 30 each hingedly 32 connected at the center. At the other distal end of the cushion frame 30 are collapsible leg supports 34 that fold up allowing the cushions 28 to rest on the floor's surface at an angle from the pivot point. Also disclosed are internal extendable braces 42 for raising the cushions 28.

8 Claims, 9 Drawing Sheets

DUMBBELL WORKBENCH

FIELD OF THE INVENTION

1. Field of the Invention

The present invention relates generally to exercise devices and, more specifically, to a workout bench having a plurality of incline adjustments and stanchions with means for receiving dumbbell weights. The dumbbell stanchion comprises a tubular structure having a base portion extending transversely to its distal ends, forming vertical stanchions. The vertical stanchions comprise a weight rest stanchion that is slidably adjustable having apertures linearly arranged in conjunction with a locking pin provided on the main vertical stanchions. The bench comprises two cushions fixedly attached to individual frame structures each hingedly connected at the center. At the other distal end of the cushion frame are collapsible leg supports that fold up allowing the cushions to rest on the floor's surface at an angle from the pivot point. Along with internal extendable hinges for raising the cushions.

2. Description of the Prior Art

There are other weight stands designed for dumbbell use. Typical of these is U.S. Pat. No. 4,477,074 issued to Bushnell on Oct. 16, 1984.

Another patent was issued to Segrist, et al. on May 19, 1987 as U.S. Pat. No. 4,666,150. Yet another U.S. Pat. No. 5,411,459 was issued to Hayden on May 2, 1995 and still yet another was issued on Dec. 5, 1995 to Ammoscato, et al. as U.S. Pat. No. 5,472,397.

Another patent was issued to Hayden on Apr. 1, 1997 as U.S. Pat. No. 5,616,108. Yet another U.S. Pat. No. 5,725,460 was issued to Marsh on Mar. 10, 1998. Another was issued to Hayden on Jul. 20, 1999 as U.S. Pat. No. 5,924,964 and still yet another was issued on Aug. 20, 2002 to Valention as U.S. Pat. No. 6,436,016.

Another patent was issued to Ammoscato on Dec. 4, 1995 as Canadian Patent No. 2,164,368. Yet another WIPO Patent No. WO 99/39778 was issued to Marcheschi on Aug. 12, 1999.

U.S. Pat. No. 4,477,074

Inventor: Donald D. Bushnell

Issued: Oct. 16, 1984

A bench press apparatus having a bench carried on a frame. The apparatus includes two spaced apart upstanding members that have on their respective ends two spaced apart arms for receiving a barbell. Underneath the apparatus there is a support for supporting at least one dumbbell. Said support includes structure to prevent a dumbbell from moving laterally. On the underneath side of bench there is structure to support the bar of a barbell. The bar prevents the removal of a dumbbell from its support under the bench.

U.S. Pat. No. 4,666,150

Inventor: Joseph S. Segrist

Issued: May 19, 1987

A saddle mountable on telescoping tubular members or permanent tubular members that will support a complete dumbbell cooperating with an open area centrally located throughout the dumbbell receiving area of saddle to allow a hand to pass through on the return of the dumbbell to the saddle. A guide positioned on saddle above open area that directs the plates or assembled weight of a dumbbell away from the open area positioning the dumbbell into its perfect resting area thus giving the user a unique device to support, receive and position a dumbbell into a saddle as well as the capability of positioning a heavy pair of dumbbells into a convenient liftable position to begin various exercises.

U.S. Pat. No. 5,411,459

Inventor: Richard C. Hayden

Issued: May 2, 1995

A dumbbell rack attachment to be inserted into the column of an exercise weight bench having a single vertical support and a rack assembly with two grooved weight bearing surfaces divided by an open space for the hand to pass through so that the weights of a dumbbell can rest in the grooved weight bearing surface and not roll out.

U.S. Pat. No. 5,472,397

Inventor: Vincenzo Ammoscato

Issued: Dec. 5, 1995

An exercise bench for movably supporting a pair of dumbbells on opposed sides of the bench within reach of a user is disclosed. The inventive device includes a main frame having a seat supported thereby with a backrest pivotally mounted to the seat. A center stanchion extends from the backrest to the main frame and can be adjusted so as to position the backrest at a desired angle. A pair of dumbbell supports are pivotally mounted to the center stanchion and are each operable to movably support a dumbbell thereon. A foot actuator connected to the dumbbell supports by a cable is operable both to pivot the dumbbell supports into reach prior to commencing of an exercise procedure, and to pivot the supports out of the way during the exercise procedure.

U.S. Pat. No. 5,616,108

Inventor: Richard C. Hayden

Issued: Apr. 1, 1997

A dumbbell support attachment for holding a dumbbell from a barbell cross bar so that the dumbbell can be used with a typical weight lifting bench. Suspended from the barbell cross bar when it is supported, in the usual manner, above the weight lifting bench, the attachment provides the user with a convenient support on which to mount a dumbbell at the beginning and end of an exercise routine. The attachment includes a segmented section and an elongated hook, which together form an integral unit preferably fabricated from steel or the like. Adapted for mounting over the cross bar, the hook opens downwardly and has an inner surface disposed generally along a semicircular arc of slightly larger diameter than that of the crossbar. The segmented section, on the other hand, opens upwardly and has a curved inner surface with a radius of curvature which is larger than that of the outer periphery of the heaviest dumbbell weights to be used. So that the user, as he lies on the weight bench, can grab the dumbbell and lift it from its resting position within the segmented section, the bottom portion thereof defines two cutouts. The center of gravity of the attachment and one or more dumbbells supported therein is located directly below the barbell cross bar. Tabs attached to each end of the segmented section are provided to stabilize the attachment, preventing its rotation about the cross bar, whenever one or both of the dumbbells is taken out of or placed in the attachment.

U.S. Pat. No. 5,725,460

Inventor: John P. Marsh

Issued: Mar. 10, 1998

A bench-type weight support having racks at opposite sides of a bench is disclosed. The racks support adjustable saddles which receive weights such as dumbbells. The saddles are angularly disposed to provide the proper alignment when grasped by a user from a supine position. In the preferred embodiment, the bench has a seat and a back which are independently adjustable to provide a wide range of exercising positions.

U.S. Pat. No. 5,924,964

Inventor: Richard C. Hayden

Issued: Jul. 20, 1999

An attachment which can be mounted on popular weight lifting exercise equipment, to facilitate workouts using hand-held weights commonly referred to as dumbbells. The attachment comprises a rack assembly on which an athlete can support up to two dumbbells simultaneously. Readily adaptable for use with any weight lifting bench, the attachment includes a pair of mounting legs rigidly attached to distal ends of the rack assembly and an extension bar slideably connected to opposing parts of this assembly for adjusting the span between these mounting legs. By utilizing the span adjusting means, one can align the mounting legs with the weight support columns of any particular weight lifting bench even though the spacing between these columns may differ substantially from that of other benches. Moreover, the rack assembly is attached to the mounting legs in such a way that when a dumbbell rests on the assembly, the center of gravity of the dumbbell is disposed generally in the same vertical plane as are the weight support columns, thereby helping to stabilize the attachment. This feature allows an alternate embodiment of the attachment to be used safely in combination with free-standing weight support columns.

U.S. Pat. No. 6,436,016

Inventor: Anthony J. Valentino

Issued: Aug. 20, 2002

Disclosed is a weight-lifting apparatus for use by bodybuilders and professional power lifters. The apparatus includes a specially designed dumbbell and dumbbell suspension hook. The dumbbell has ends to which weights may be added and removed to reach certain lifting weights. The dumbbell further has an attached handle from which the dumbbell may be suspended from the hook, which is located on a weight bench. The handle is U-shaped so as to work in unison with the specially designed J-shaped hook. The hook is designed to catch and hold the U-shaped handle, allowing it to drop down into the hook and to self-center the dumbbell at its equilibrium position. The dumbbells and suspension hooks are intended to be used together to eliminate the need for spotters, while optimizing safety.

Canadian Patent Number 2,164,368

Inventor: Vincenzo Ammoscato

Issued: Jun. 5, 1997

An exercise bench for movably supporting a pair of dumbbells on opposed sides of the bench within reach of a user. The inventive device includes a main frame having a seat supported thereby with a back rest pivotally mounted to the seat. A center stanchion extends from the back rest to the main frame and can be adjusted so as to position the back rest at a desired at a desired angle. A pair of dumbbell supports are pivotally mounted to the center stanchion and are each operable to movably support a dumbbell thereon. A foot actuator connected to the dumbbell supports by a cable is operable both to pivot the dumbbell supports into reach prior to commencing of an exercise procedure, and to pivot the supports out of the way during the exercise procedure.

W.I.P.O. Patent Number WO 99/39778

Inventor: David P. Marcheschi

Issued: 12 Aug. 1999

A dumbbell support assembly has a laterally extending base member have attached at each end a pivoting strut base. Each pivoting strut base has a vertical strut with a dumbbell support adapted to support a dumbbell thereon. Each dumbbell support can be rotatable about an axis defined by the strut. The assembly can be positioned anywhere along the length of the chair or bench in a desired position. The struts have a vertical height adjustment feature enabling each dumbbell holder to be adjusted in height, independently of the other. The angle of each dumbbell relative to a vertical axis can be selected, independently. The optional rotating adjustment of the dumbbell holder allows the user to precisely angle each dumbbell, independently of the other.

While these dumbbell stands may be suitable for the purposes for which they were designed, they would not be as suitable for the purposes of the present invention, as hereinafter described.

SUMMARY OF THE PRESENT INVENTION

The present invention discloses a workout bench having a plurality of incline adjustments and stanchions with means for receiving dumbbell weights. The dumbbell stanchion comprises a tubular structure having a base portion extending transversely to its distal ends, forming vertical stanchions. The vertical stanchions comprise a weight rest stanchion with weight rest that is slidably adjustable having apertures linearly arranged in conjunction with a locking pin provided on the main vertical stanchions. The bench comprises two cushions fixedly attached to individual frame structures each hingedly connected at the center. At the other distal end of the cushion frame are collapsible leg supports that fold up allowing the cushions to rest on the floor's surface at an angle from the pivot point. Also disclosed are internal extendable braces for raising the cushions.

A primary object of the present invention is to provide a workout bench for dumbbells.

Another object of the present invention is to provide a workout bench for dumbbells having spaced apart racks for holding dumbbells therein.

Yet another object of the present invention is to provide a workout bench for dumbbells wherein a first and second cushion have means for lower one end to a 45 degree angle.

Still yet another object of the present invention is to provide a workout bench wherein the frame of the seat cushion incorporates a hinge for selectively raising said cushion in predetermined increments to 90 degrees.

Another object of the present invention is to provide a workout bench wherein the frame incorporates a quick release rack for receiving the dumbbells off the lower end of the workbench.

Additional objects of the present invention will appear as the description proceeds.

The present invention overcomes the shortcomings of the prior art by providing a workout bench having a plurality of incline adjustments and stanchions with means for receiving dumbbell weights. The dumbbell stanchion comprises a tubular structure having a base portion extending transversely to its distal ends, forming vertical stanchions. The vertical stanchions comprise a weight rest stanchion that is slidably adjustable having apertures linearly arranged in conjunction with a locking pin provided on the main vertical stanchions. The bench comprises two cushions fixedly attached to individual frame structures each hingedly connected at the center. At the other distal end of the cushion frame are collapsible leg supports that fold up allowing the cushions to rest on the floor's surface at an angle from the pivot point. Along with internal extendable hinges for raising the cushions.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
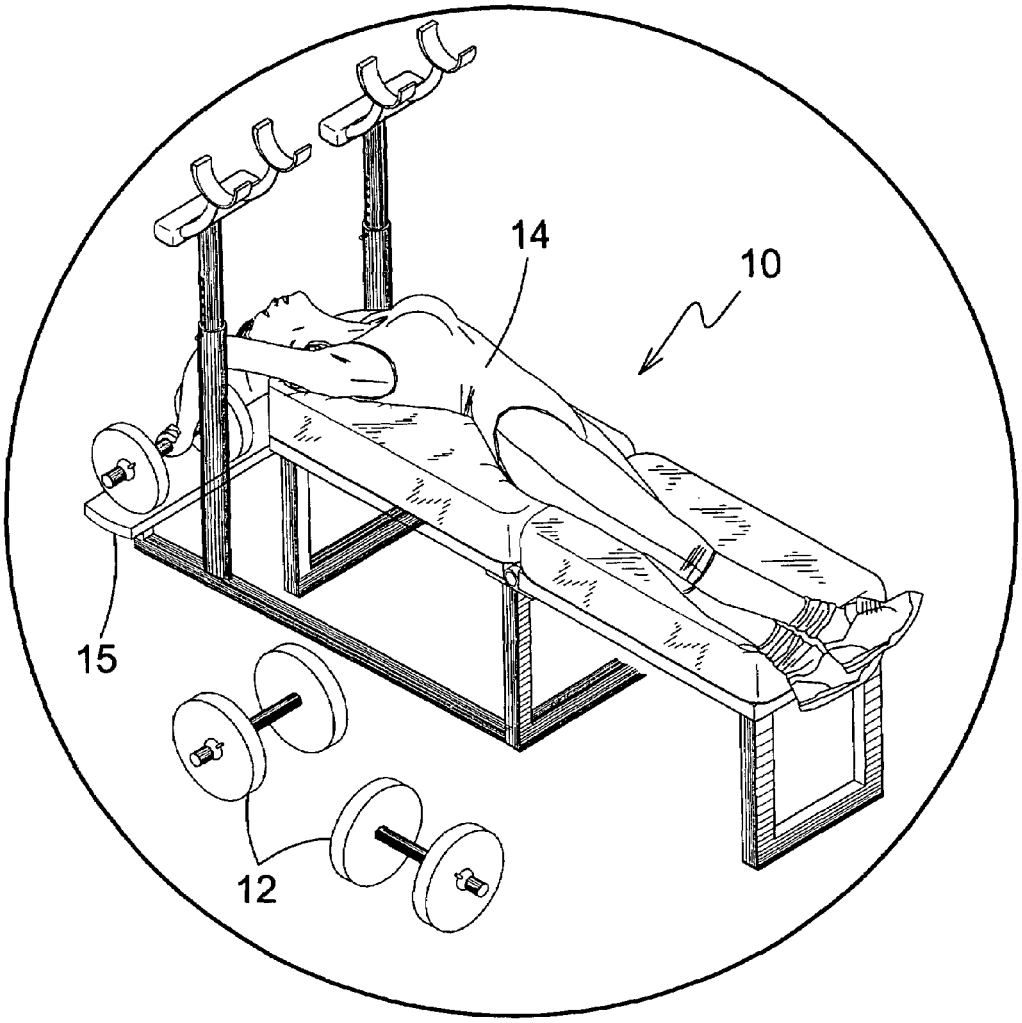
FIG. 1 is an illustrative view of the present invention in use.

With regard to reference numerals used, the following numbering is used throughout the drawings.

10 present invention
12 dumbbell weight
14 user
15 dumbbell receptacle
16 vertical stanchion
18 weight stanchion
19 weight rest
20 adjustable member
22 apertures
24 pins
26 bench
28 cushions
30 bench frame
32 hinge
34 folding leg
36 stationary leg
38 base frame
40 arrow
42 braces

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 is a workout bench for a user 14 having a plurality of incline adjustments and stanchions with means for receiving dumbbell weights 12. The dumbbell stanchion comprises a tubular structure having a base portion extending transversely to its distal ends, forming vertical stanchions. The vertical stanchions comprise a weight rest stanchion that is slidably adjustable having apertures linearly arranged in conjunction with a locking pin provided on the main vertical stanchions. The bench comprises two cushions fixedly attached to individual frame structures each hingedly connected at the center. At the other distal end of the cushion frame are collapsible leg supports that fold up allowing the cushions to rest on the floor's surface at an angle from the pivot point. A dumbbell receptacle 15 is provided for receiving the dumbbells 12 therein.

Figure 2:
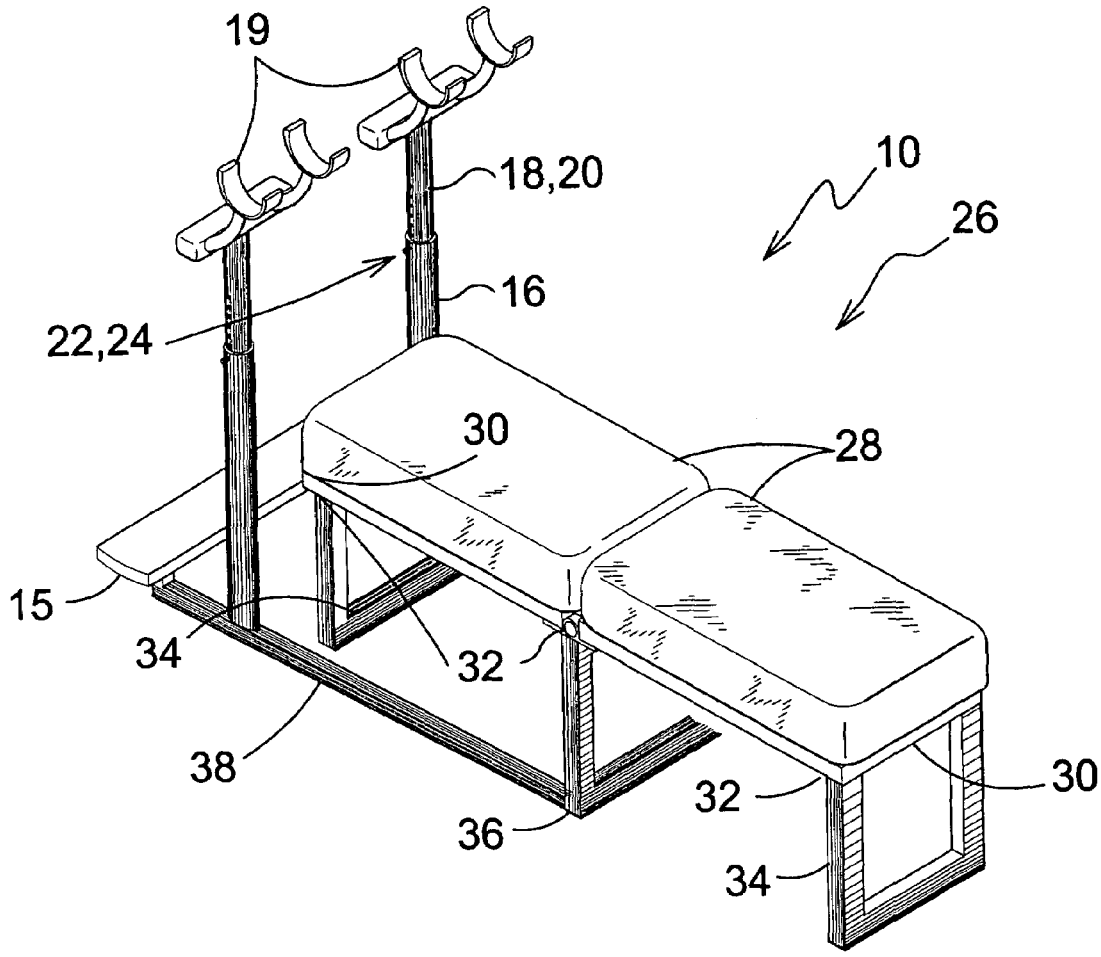
FIG. 2 is a perspective view of the present invention.

Turning to FIG. 2, shown therein is a perspective view of the present invention 10. Shown is the workout bench of the present invention 10 with receptacle 15 having a plurality of incline adjustments and stanchions 16 with means for receiving dumbbell weights. The dumbbell stanchion comprises a telescoping tubular structure having a base frame portion 38 extending transversely to its distal ends, forming vertical stanchions 16. The vertical stanchions 16 comprise a weight rest stanchion 18 with weight rest 19 that is slidably adjustable at 20 having apertures 22 linearly arranged in conjunction with a locking pin 24 provided on the main vertical stanchions. The bench 26 comprises two adjustable cushions 28 fixedly attached to individual frame structures 30 each hingedly connected at 32 at the center. At the other distal end of the cushion frame 30 are collapsible, folding leg 34 supports that fold up allowing the cushions 28 to rest on the floor's surface at an angle from the pivot point. Also shown is stationary leg 36.

Figure 3:
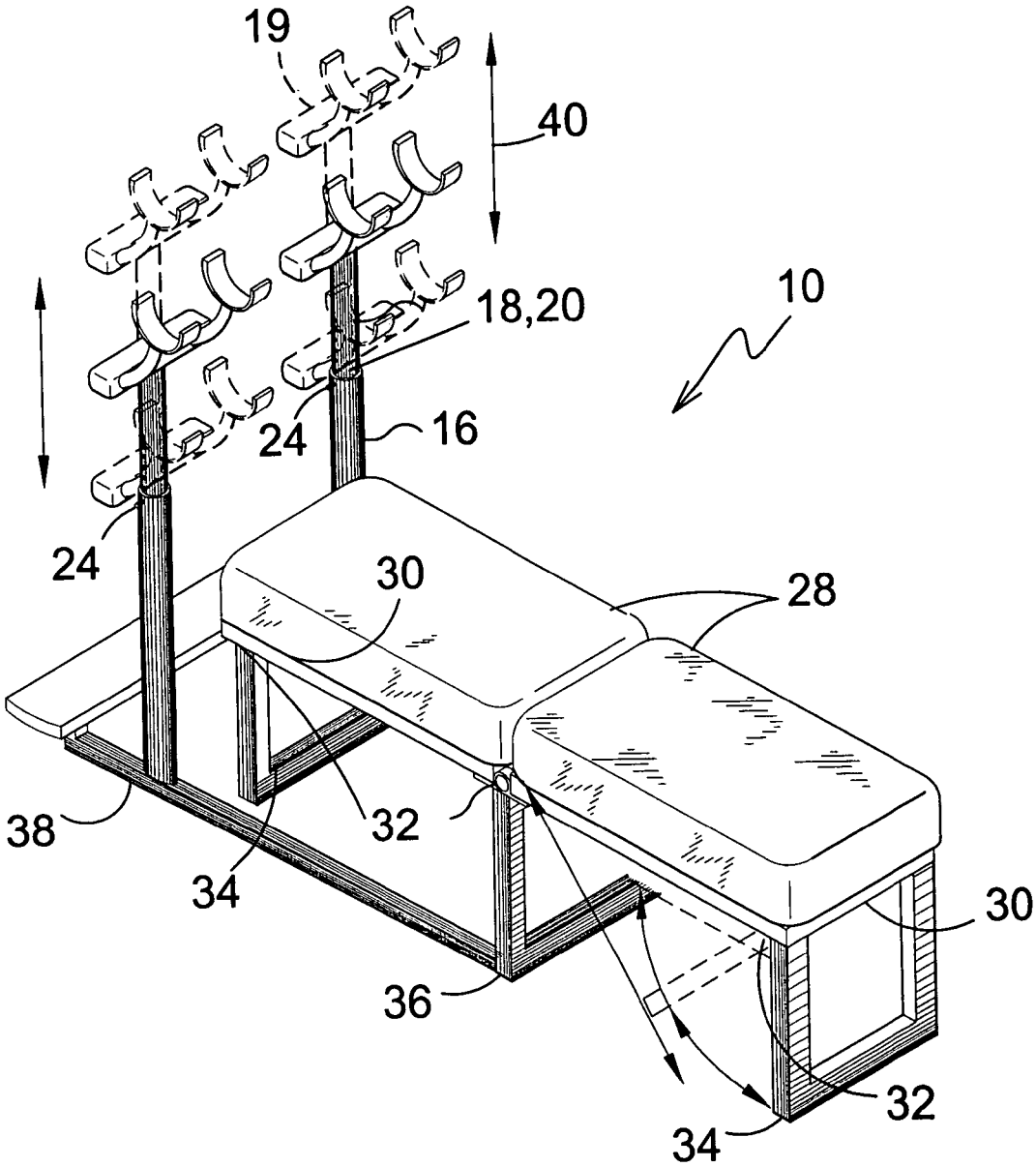
FIG. 3 is a perspective view of the present invention.

Turning to FIG. 3, shown therein is a perspective view of the present invention 10. The workout bench dumbbell stanchions 16 comprise a tubular structure having a base portion 38 extending transversely to its distal ends, forming vertical stanchions. The vertical stanchions 16 comprise a weight rest stanchion 18 with weight rest 19 that is slidably adjustable at 20 as shown by arrow 40 having apertures linearly arranged in conjunction with a locking pin 24 provided on the main vertical stanchions. The bench comprises two cushions 28 fixedly attached to individual frame structures 30 each hingedly 32 connected at the center. At the other distal end of the cushion frame are collapsible leg supports 34 that fold up allowing the cushions to rest on the floor's surface. Also shown is stationary leg 36.

Figure 4:
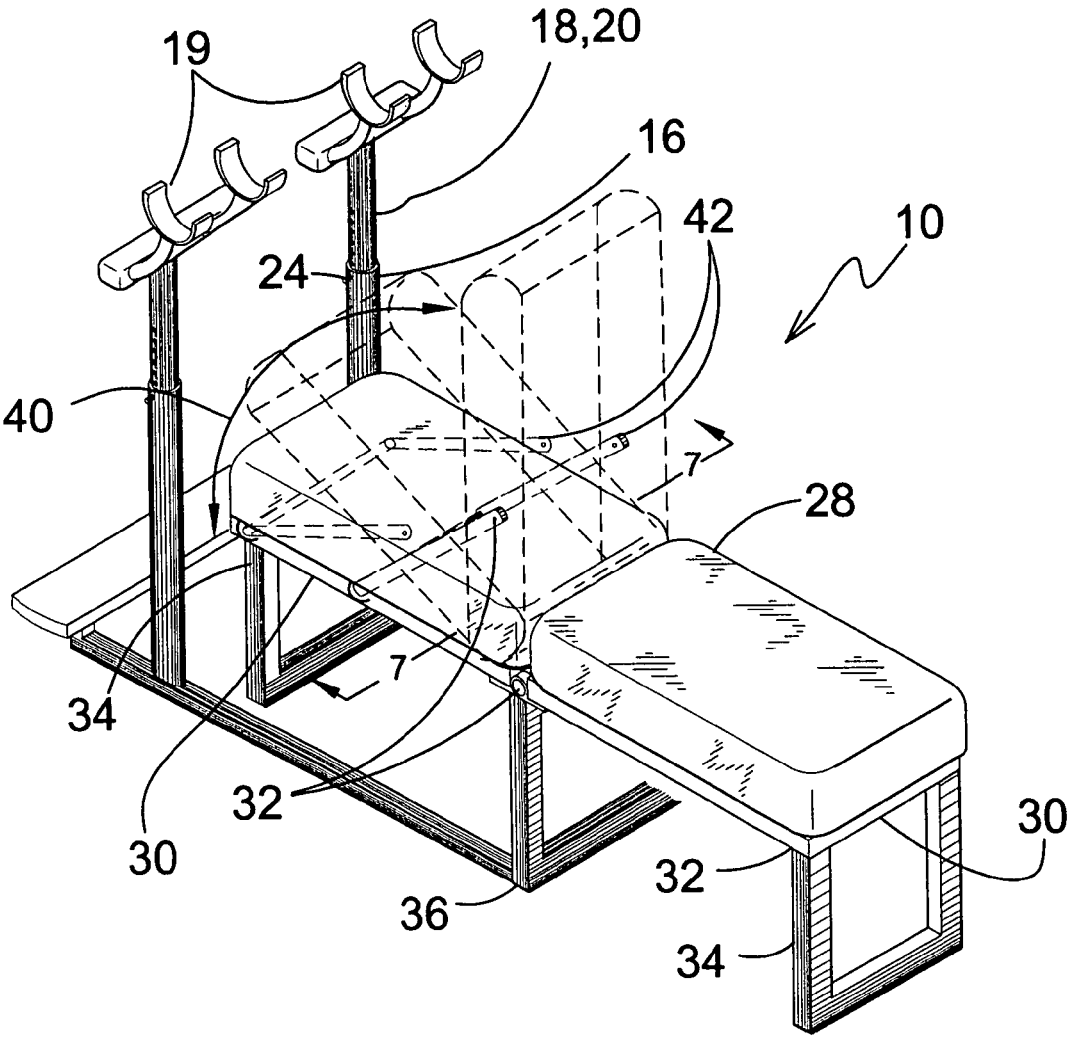
FIG. 4 is a perspective view of the present invention.

Turning to FIG. 4, shown therein is a perspective view of the present invention 10. The present invention 10 is a workout bench having two cushions 28 fixedly attached to individual frame structures 30 each hingedly 32 connected at the center. At the other distal end of the cushion frame are collapsible leg supports 34 that fold up allowing the cushions 28 to rest on the floor's surface at an angle from the pivot point. Also shown are integral cushion support elements or braces 42 whereby the cushion 28 can be moved in predetermined increments from a horizontal to vertical position. Also shown are stanchions 16, 18, adjustable member 20 with pin 24, stationary leg 36, arrow 40 and weight rest 19.

Figure 5:
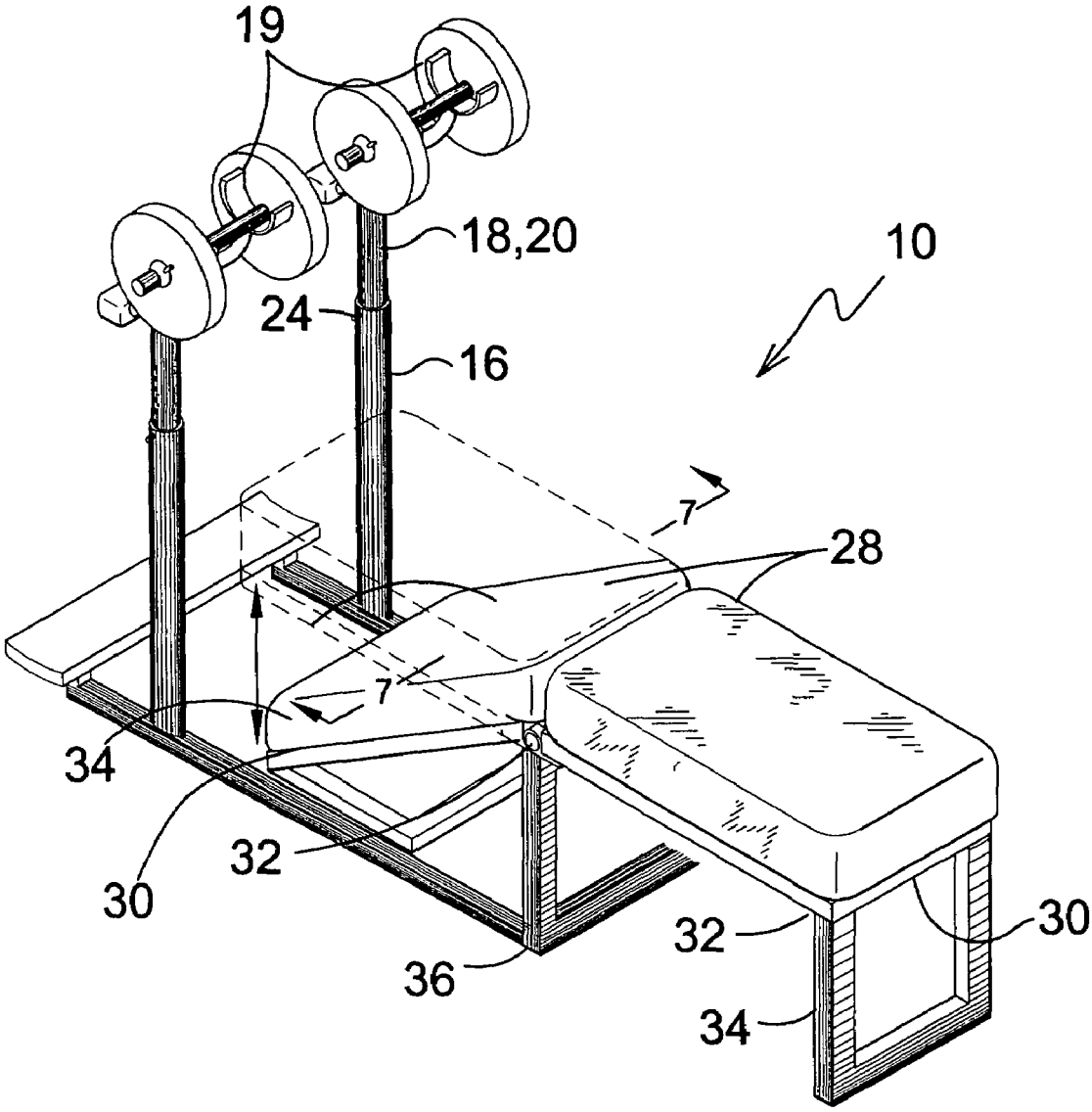
FIG. 5 is a perspective view of the present invention.

Turning to FIG. 5, shown therein is a perspective view of the present invention 10. The present invention 10 is a workout bench having two cushions 28 fixedly attached to individual frame structures 30 each hingedly 32 connected at the center. At the other distal end of the cushion frame are collapsible leg 34 supports that fold up allowing the cushions 28 to rest on the floor's surface at an angle from the central pivot point. Other previously disclosed elements are also shown.

Figure 6:
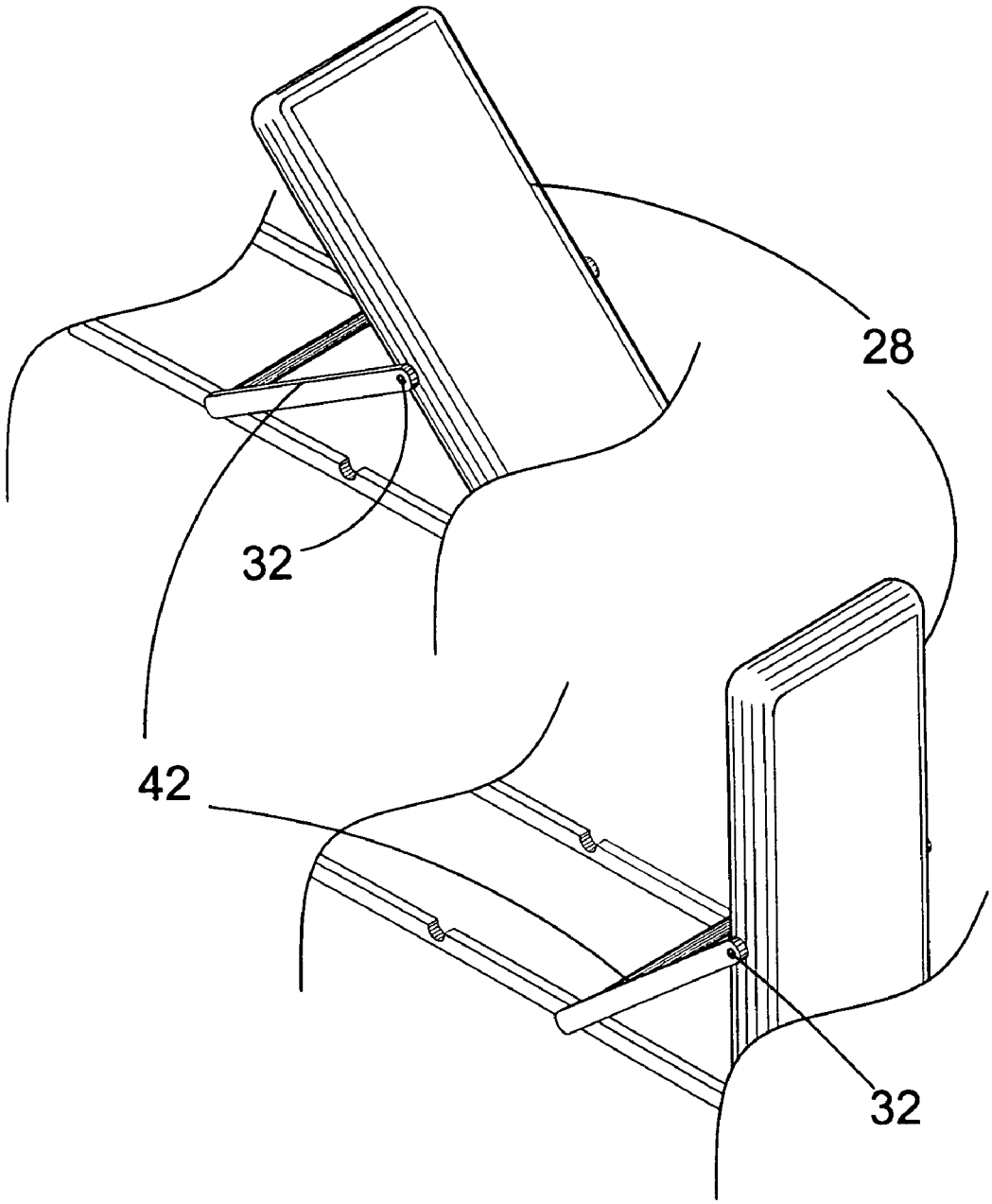
FIG. 6 is a perspective view of the angle adjustment of the present invention.

Turning to FIG. 6, shown therein is a perspective view of the angle adjustment of the present invention. Shown are integral cushion support elements or braces 42 whereby the cushion 28 can be moved in predetermined increments from a forty-five degree position to a ninety degree position. Also shown are hinges 32.

Figure 7:
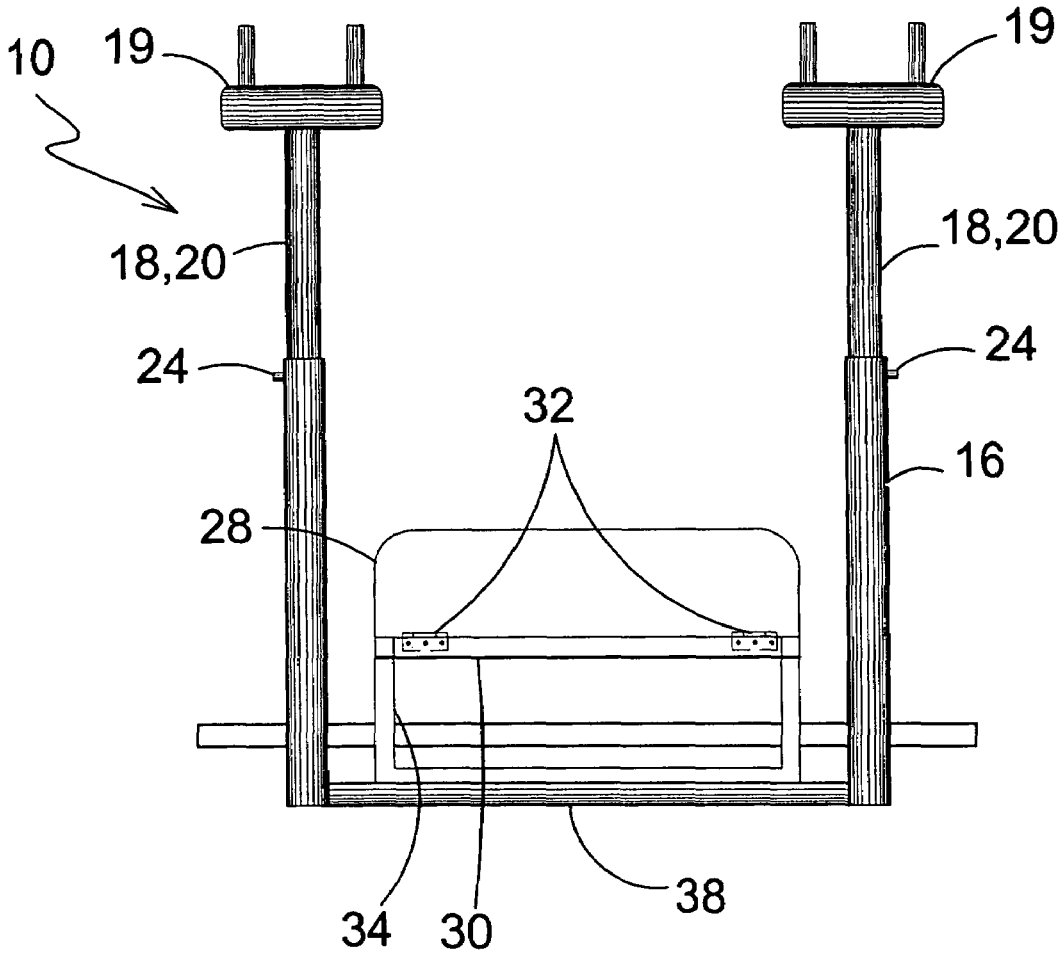
FIG. 7 is a sectional view of the present invention.

Turning to FIG. 7, shown therein is a sectional view of the present invention 10. The present invention 10 is a workout bench having two cushions 28 fixedly attached to individual frame structures 30 each hingedly 32 connected at the center. At the other distal end of the cushion frame are collapsible leg supports 34 on hinges that fold up allowing the cushions 28 to rest on the floor's surface at an angle from the pivot point. Other previously disclosed elements are also shown.

Figure 8:
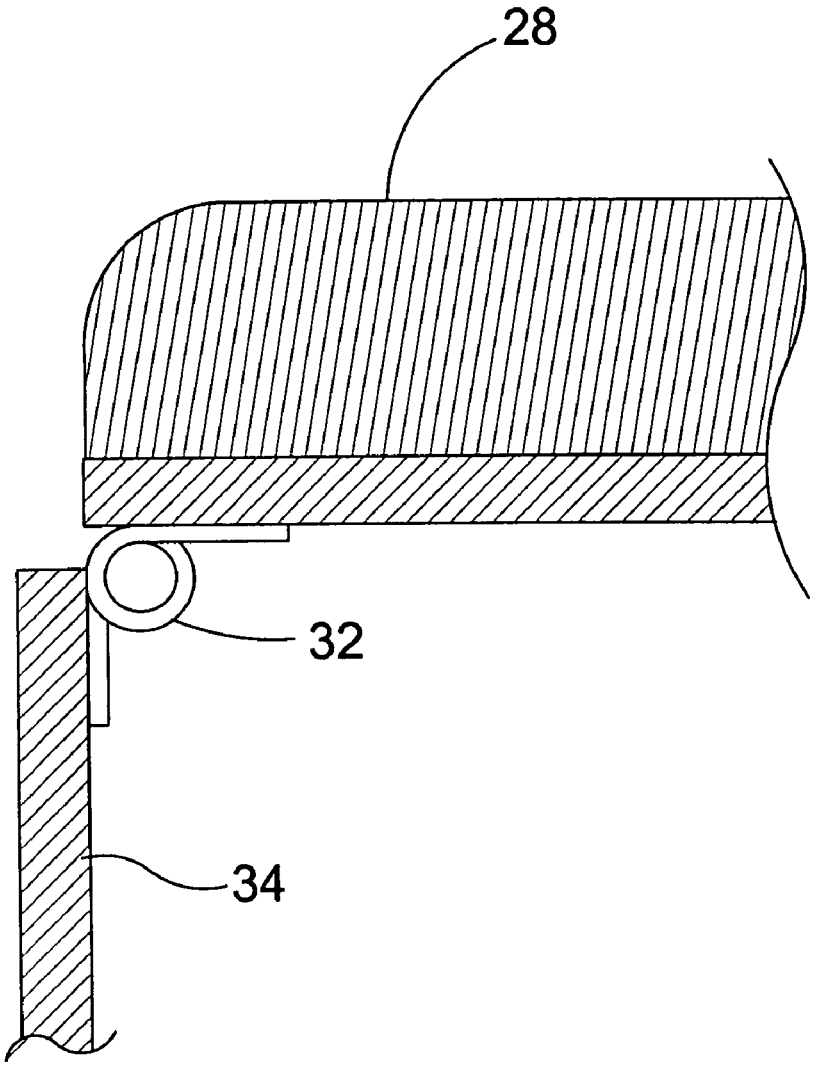
FIG. 8 is a sectional view of the hinged support.

Turning to FIG. 8, shown therein is a sectional view of the hinged support 32. The present invention 10 is a workout bench having two cushions 28 fixedly attached to individual frame structures each hingedly connected at the center. At the other distal end of the cushion frame are collapsible leg supports 34 on hinges that fold up allowing the cushions 28 to rest on the floor's surface at an angle from the pivot point.

Figure 9:
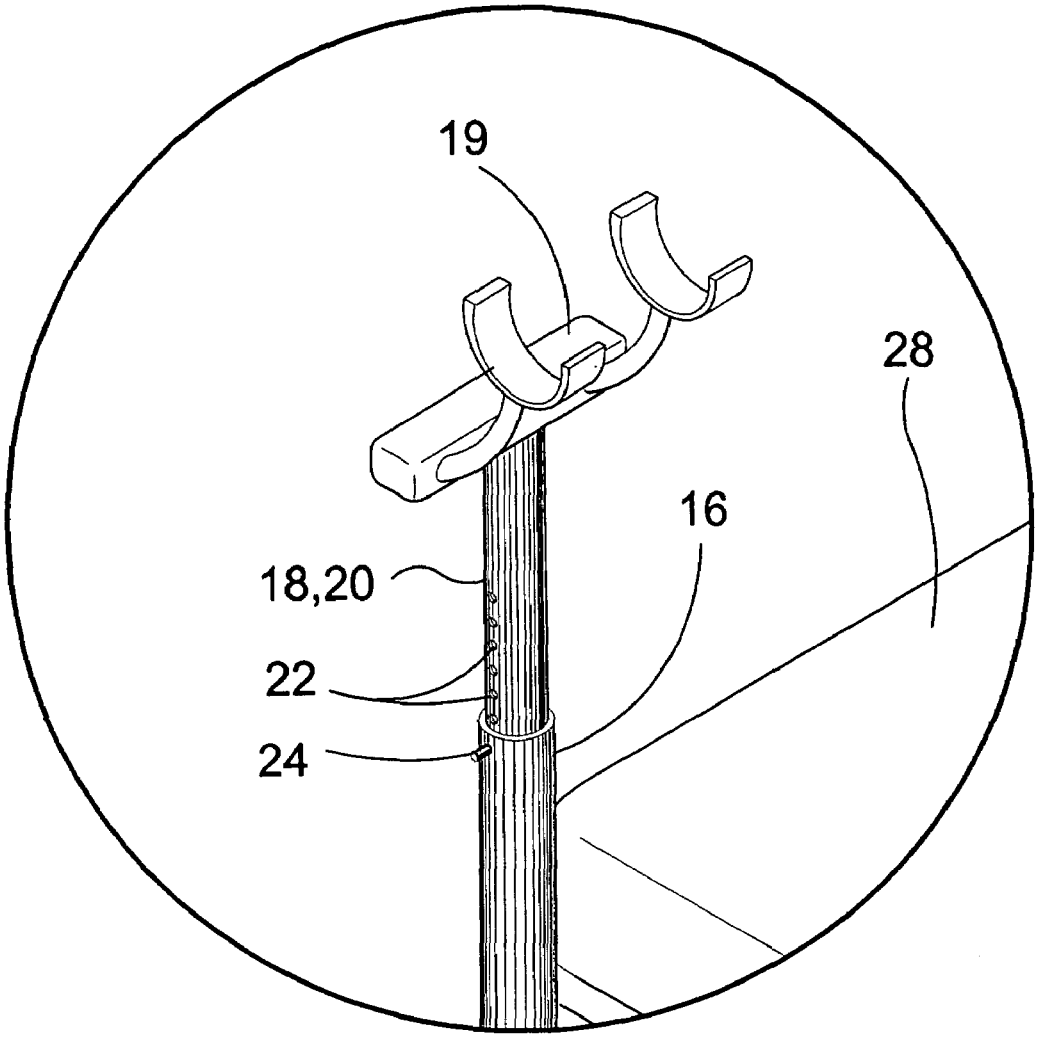
FIG. 9 is an enlarged view of the dumbbell holder.

Turning to FIG. 9, shown therein is an enlarged view of the dumbbell holder 18. The present invention 10 is a workout bench having a plurality of incline adjustments and stanchions with means for receiving dumbbell weights. The dumbbell stanchion 16 comprises a tubular structure having a base portion extending transversely to its distal ends, forming vertical stanchions. The vertical stanchions 16 comprise a weight rest stanchion 18 with weight rest 19 that is slidably adjustable at 20 having apertures 22 linearly arranged in conjunction with a locking pin 24 provided on the main vertical stanchions.

What is claimed to be new and desired to be protected by Letters Patent is set forth in the appended claims.

I claim:

1. A dumbbell workout bench, comprising:

a) a first support frame, said first frame being substantially horizontal for engaging the ground, said first frame comprising first and second elongated parallel spaced apart ground engaging members, said first and second members each having first and second opposing ends and a top and bottom surface, said bottom surface engaging the ground;

b) a dumbbell receptacle being disposed on said top surface of said first end of said first support frame for receiving at least one dumbbell thereon;

c) a first pair of upwardly extending support legs being disposed on said top surface of said second end of said first support frame, wherein one each of said support legs corresponds to one of each of said first and second members of said first support frame, each of said support legs having first and second opposing ends wherein said second end is an upper end and said first end and is attached to said first support frame;

d) a pair of vertical stanchions disposed on said top surface of said first support frame adjacent said dumbbell receptacle and between said dumbbell receptacle and said first pair of upwardly extending support legs, wherein one each of said vertical stanchions corresponds to one each of said first and second members of said first support frame, each of said vertical stanchions having first and second opposing ends wherein said second end is an upper end and said first end is attached to said first support frame, wherein said pair of vertical stanchions are tubular;

e) a pair of weight stanchions each having first and second opposing ends, wherein said first end of one said weight stanchions is slidably disposed in said upper end of each said tubular vertical stanchions, a weight rest being disposed on said second end of said weight stanchion;

f) a second support frame being hingedly disposed on said upper end of said first pair of support legs, said second frame being substantially horizontal for supporting a user, said second frame having first and second opposing ends having a central hinge in the middle of said first and second opposing ends forming forward and rearward portions thereof, the forward portion extending between the central hinge and said first opposing end thereof and the rearward portion extending between the central hinge and the second opposing end thereof wherein said first and second opposing ends each extend away from said middle, said second frame having top and bottom surfaces, wherein said first opposing end of said second support frame is disposed adjacent said vertical stanchions between said vertical stanchions and said first pair of upwardly extending support legs so that arms of a user can reach the upper end of each vertical stanchion, wherein said second opposing end of said second support frame is disposed away from said first pair of upwardly extending support legs so that legs of a user extend away from the vertical stanchions, said first opposing end of said second support frame resting on said ground when a first folding, downwardly extending support leg is folded up against said bottom surface of said second support frame;

g) a second folding, downwardly extending support leg disposed on said bottom surface of the second opposing end of said second support frame, said second leg of said second support frame having first and second opposing ends wherein said first opposing end thereof is hingedly connected to said second support frame and said second opposing end thereof engages the ground to permit the second support frame to be supported and to permit the second end of the second support frame to be folded down to the ground when said second support leg is in a folded position, said first end of said second support frame when on the ground is between said first and second elongated parallel spaced apart ground engaging members;

h) a cushion for supporting a user being disposed on said top surface of said second support frame;

i) said cushion comprising first and second cushions having first and second opposing ends wherein said second ends of said cushions are oriented toward said middle of said second support frame, wherein the first and second cushions are disposed on each of said forward and rearward portions respectively of said second support frame wherein the first cushion on said forward portion of said second support frame is tilted down from said central hinge when said folding, downwardly extending support leg on the first end of said second support frame is folded up against the bottom surface of said second support frame; and j) means for incrementally tilting said first cushion from a horizontal position to a vertical position up from the second end of said second support frame.

2. The dumbbell workout bench of claim 1, wherein said means for incrementally tilting said first cushion comprises at least one brace having first and second ends, said first end of said brace adapted to connect to said first cushion, said second end of said brace adapted to connect to said second support frame to permit the first cushion to be moved in increments to form about a forty-five degree angle to about a ninety-degree angle with the second support frame.

3. The dumbbell workout bench of claim 2, wherein said first support frame, said first pair of upwardly extending support legs, said second support frame, and said second folding downwardly extending support leg are made of tubular material.

4. The dumbbell workout bench of claim 3, wherein said dumbbell receptacle is upwardly concave for containing a dumbbell therein.

5. The dumbbell workout bench of claim 4, wherein said second folding downwardly extending support leg fold toward said middle of said second support frame so as to be flush with said bottom surface of said second support frame.

6. The dumbbell workout bench of claim 5, wherein said upper end of said pair of vertical stanchions each have at least one aperture therein, said apertures for receiving a mating pin therein.

7. The dumbbell workout bench of claim 6, wherein said first end of said weight stanchion has a plurality of longitudinally spaced apart apertures therein wherein one of said apertures receives said pin from said vertical stanchion to permit the weight stanchion to be adjusted upwardly and downwardly.

8. The dumbbell workout bench of claim 7, wherein said weight rest is upwardly concave so as to receive a dumbbell therein.

* * * * *